US008831469B2

(12) United States Patent
Kim et al.

(10) Patent No.: US 8,831,469 B2
(45) Date of Patent: Sep. 9, 2014

(54) IMAGE FORMING APPARATUS

(75) Inventors: Gun Wook Kim, Suwon-si (KR); Jin Ho Park, Yongin-si (KR); Young Min Yoon, Suwon-si (KR); Byung Jo Lee, Bucheon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 105 days.

(21) Appl. No.: 13/553,171

(22) Filed: Jul. 19, 2012

(65) Prior Publication Data

US 2013/0022378 A1 Jan. 24, 2013

(30) Foreign Application Priority Data

Jul. 22, 2011 (KR) ..... 10-2011-0072746

(51) Int. Cl.
*G03G 21/00* (2006.01)
*G03G 21/16* (2006.01)

(52) U.S. Cl.
CPC ..... *G03G 21/00* (2013.01); *G03G 21/1633* (2013.01); *G03G 2221/0089* (2013.01); *G03G 2221/169* (2013.01)
USPC ..... 399/99; 399/74; 399/124

(58) Field of Classification Search
CPC ..... G03G 21/1623; G03G 21/1633; G03G 2221/169
USPC ..... 399/74, 99, 124
See application file for complete search history.

(56) References Cited

U.S. PATENT DOCUMENTS

2008/0187343 A1* 8/2008 Yamaguchi et al. ..... 399/74
2009/0080948 A1* 3/2009 Takei ..... 399/308
2009/0274478 A1* 11/2009 Kang ..... 399/98

FOREIGN PATENT DOCUMENTS

JP 2002-006587 1/2002
JP 2005-004122 1/2005
JP 2005-070676 3/2005

OTHER PUBLICATIONS

European Patent Office Search Report mailed Oct. 25, 2012 in Application No. 12176923.6-2216.

* cited by examiner

*Primary Examiner* — Benjamin Schmitt
(74) *Attorney, Agent, or Firm* — Staas & Halsey LLP

(57) ABSTRACT

An image forming apparatus including a main body provided with an opening, a cover to open and close the opening, a plurality of development units developing electrostatic latent images into visible images through developers, a transfer device including an intermediate transfer belt receiving the developers from the plurality of development units and transferring the developers to printing media, and a sensor unit provided with light windows located at first positions opposite the intermediate transfer belt when the opening is closed by the cover, and located at second positions exposed to the opening when the opening is opened by the cover. Thereby, a user may clean the light windows through the opening.

18 Claims, 6 Drawing Sheets

IMAGE FORMING APPARATUS

CROSS-REFERENCE TO RELATED APPLICATIONS

This application claims the benefit of Korean Patent Application No. 10-2011-0072746, filed on Jul. 22, 2011 in the Korean Intellectual Property Office, the disclosure of which is incorporated herein by reference.

BACKGROUND

1. Field

Embodiments of the present invention relate to an image forming apparatus having a sensor unit checking developers on an intermediate transfer belt.

2. Description of the Related Art

Image forming apparatuses forms an image on printing media, and correspond to printers, copiers, facsimile machines, and multi-function apparatuses having functions thereof.

An image forming apparatus includes a development device converting an electrostatic latent image into a visible image through a developer, an exposure device forming the electrostatic latent image on a photoconductor of the development device by irradiating light thereon, a transfer device transferring the visible image developed on the photoconductor to a printing medium, and a fusing device to fix the developer onto the printing medium.

From among image forming apparatuses, a color image forming apparatus includes a plurality of development devices to respectively develop color developers, and a transfer device including an intermediate transfer belt to which visible images from the plural development devices are transferred in an overlapping state. Therefore, the visible images respectively formed by the plural development devices are transferred to the intermediate transfer belt in the overlapping state and then transferred to a printing medium, and thus a color image is formed on the printing medium.

Further, such an image forming apparatus executes auto color registration to precisely align and print the images according to colors at desired positions. Through auto color registration, whether or not the images according to colors are precisely printed on a printing medium is confirmed, and then the positions of the images deviated from the desired positions are automatically compensated. The color image forming apparatus includes a sensor unit checking the developers transferred on the intermediate transfer belt to execute the above-described auto color registration.

SUMMARY

Therefore, it is an aspect of the present disclosure to provide an image forming apparatus which easily cleans light windows provided on a sensor unit checking developers on an intermediate transfer belt.

Additional aspects will be set forth in part in the description which follows and, in part, will be obvious from the description, or may be learned by practice of the invention.

In accordance with one aspect, an image forming apparatus includes a main body provided with an opening, a cover to open and close the opening, a plurality of development units developing electrostatic latent images into visible images through developers, a transfer device including an intermediate transfer belt receiving the developers from the plurality of development units and transferring the developers to printing media, and a sensor unit provided with light windows located at first positions opposite the intermediate transfer belt when the opening is closed by the cover, and located at second positions exposed to the opening when the opening is opened by the cover.

The sensor unit may be rotatably installed within the main body and rotated such that the light windows move to one of the first positions and second positions.

The image forming apparatus may further include an elastic member elastically supporting the sensor unit to rotate the sensor unit.

The sensor unit may include two hinge parts respectively protruding from both sides of the sensor unit to rotatably install the sensor unit within the main body, and the elastic member may include a torsion spring and may be installed on at least one of the two hinge parts.

The sensor unit may include at least one developer concentration sensor sensing concentrations of the developers on the intermediate transfer belt, and the light windows may be provided on the at least one developer concentration sensor.

The cover may include a pressure part protruding toward the sensor unit and a support member disposed on the pressure part to elastically support the sensor unit.

The image forming apparatus may further include brushes disposed between the first positions and the second positions.

The transfer device may further include a reinforcing frame to reinforce the strength of the transfer device, through holes may be provided on the reinforcing frame at positions corresponding to the light windows located at the first positions, and each of the brushes may be located at one side of each of the through holes of the reinforcing frame.

In accordance with another aspect, an image forming apparatus includes a main body provided with an opening, a cover to open and close the opening, a plurality of development units developing electrostatic latent images into visible images through developers, a transfer device including an intermediate transfer belt receiving the developers from the plurality of development units and transferring the developers to printing media, a sensor unit provided with light windows located at first positions opposite the intermediate transfer belt when the opening is closed by the cover, and located at second positions separated from the first positions when the opening is opened by the cover, and brushes disposed between the first positions and the second positions.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
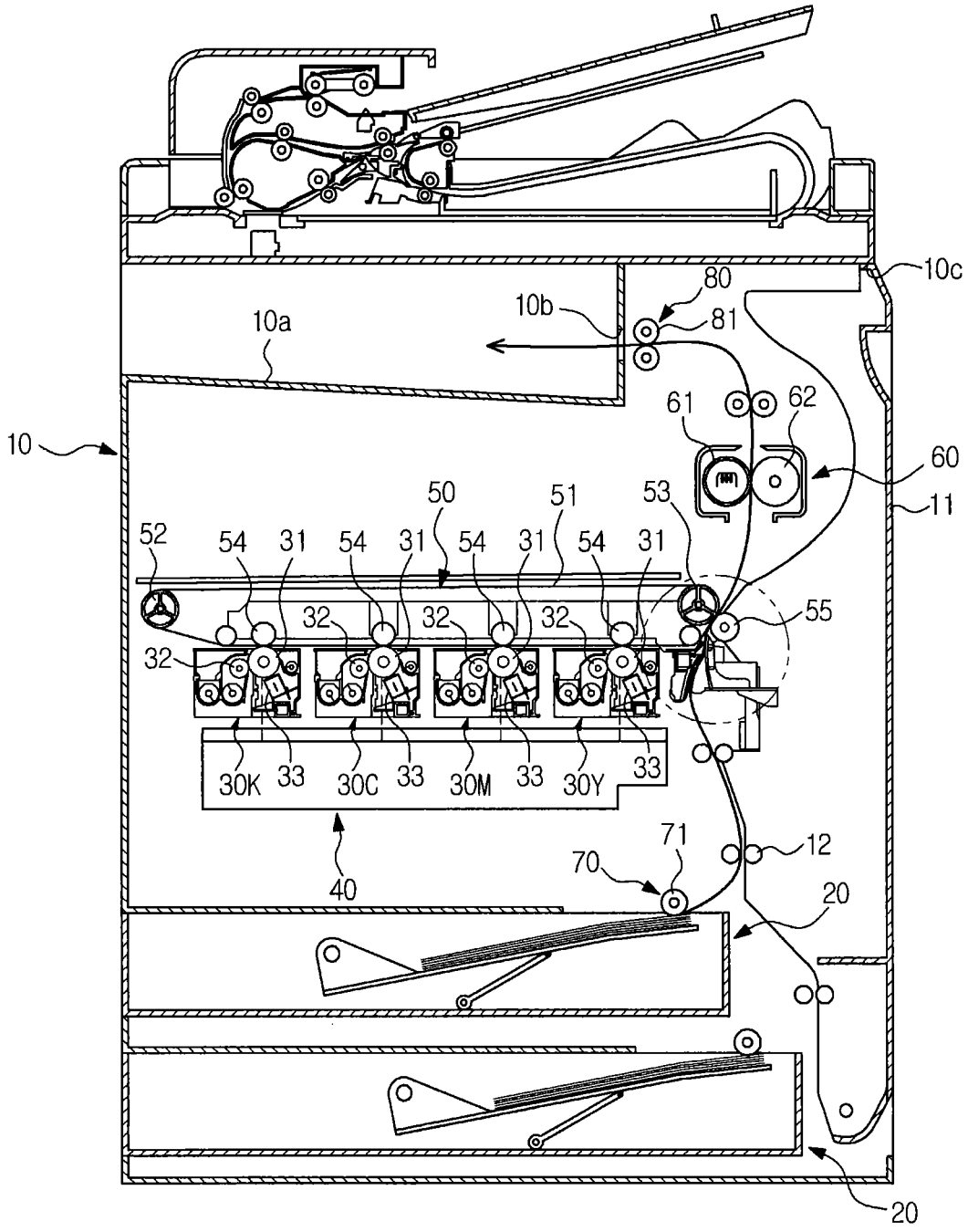
FIG. 1 is a cross-sectional view of an image forming apparatus in accordance with one embodiment of the present invention.

Reference will now be made in detail to the embodiments of the present disclosure, examples of which are illustrated in the accompanying drawings, wherein like reference numerals refer to like elements throughout.

Hereinafter, an image forming apparatus in accordance with one embodiment will be described in more detail with reference to the accompanying drawings.

The image forming apparatus in accordance with the embodiment, as shown in FIG. 1, includes a main body 10 forming the external appearance of the image forming apparatus, printing media storage units 20 in which printing media are stored, a plurality of development units 30C, 30M, 30Y and 30K developing electrostatic latent images into visible images according to colors through developers, an exposure unit 40 forming the electrostatic latent images on charged photoconductors 31 of the development units 30C, 30M, 30Y and 30K, a transfer device 50 receiving printing media from the printing media storage unit 20 and transferring the visible images formed on the photoconductors 31 to the printing media, and a fusing unit 60 fixing the developers transferred to the printing media to the printing media.

The main body 10 includes a loading part 10*a* on which printing media on which image formation has been completed are loaded, and an exit hole 10*b* through which the printing media on which image formation has been completed are discharged to the outside of the main body 10 is provided at one side of the loading part 10*a*. Further, an opening 10*c* for repair and replacement of parts provided within the main body 10 or replacement of consumables are provided at one side of the main body 10, and a cover 11 to open and close the opening 10*c* is installed. In this embodiment, the lower end of the cover 11 is rotatably installed on the main body 10 so that the cover 11 is rotated about the lower end thereof to open and close the opening 10*c*.

Each of the development units 30C, 30M, 30Y and 30K includes the photoconductor 31 provided with the surface on which an electrostatic latent image is formed by the exposure unit 40 when the surface is charged, a development roller 32 supplying a developer to the photoconductor 31, and a charging unit 33 charging the surface of the photoconductor 31.

In this embodiment, the development units 30C, 30M, 30Y and 30K include four development units 30C, 30M, 30Y and 30K, each of which stores one of developers of cyan (C), magenta (M), yellow (Y) and black (B) within a development unit housing 34, to respectively develop the developers of cyan (C), magenta (M), yellow (Y) and black (B). The four development units 30C, 30M, 30Y and 30K are disposed in parallel under the transfer device 50.

The exposure unit 40 irradiates light including image information onto the photoconductors 31 respectively provided on the development units 30C, 30M, 30Y and 30K, thus forming electrostatic latent images on the surfaces of the respective photoconductors 31.

The transfer device 20, as shown in FIG. 1, includes an intermediate transfer belt 51 to which the developers developed into the visible images on the photoconductors 31 are transferred, a driving roller 52 and a driven roller 53 disposed at both sides at the inside of the intermediate transfer belt 51 to rotate the intermediate transfer belt 51, first transfer rollers 54 disposed opposite the photoconductors 31 of the respective development units 30C, 30M, 30Y and 30K under the condition that the intermediate transfer belt 51 is interposed between the first transfer rollers 54 and the photoconductors 31 and transferring the visible images on the photoconductors 31 to the intermediate transfer belt 51, and a second transfer roller 55 disposed opposite the driven roller 53 under the condition that the intermediate transfer belt 51 is interposed between the second transfer roller 55 and the driven roller 53 and transferring the visible image on the intermediate transfer belt 51 to a printing medium.

The fusing unit 60 includes a heating roller 61 generating heat, and a pressing roller 62 formed of a material, the outer circumferential surface of which is elastically deformable, and compressing the printing media to the outer circumferential surface of the heating roller 61.

Further, pickup units 70, each of which is disposed on one side of the printing media storage unit 20 to pick up printing media on a knock-up plate 22 sheet by sheet, feed rollers 12 guiding the printing media, picked up by the pickup units 70, upwards, and an exit unit 80 disposed above the fusing unit 60 and located adjacent to the exit hole 10*b* to discharge the printing media, having passed through the fusing unit 60, through the exit hole 10*b*. The pickup unit 70 includes a pickup roller 71 to pick up the printing media on the knock-up plate 22 sheet by sheet, and the exit unit 80 includes a pair of exit rollers 81 disposed at the inside of the exit hole 10*b*.

Figure 2:
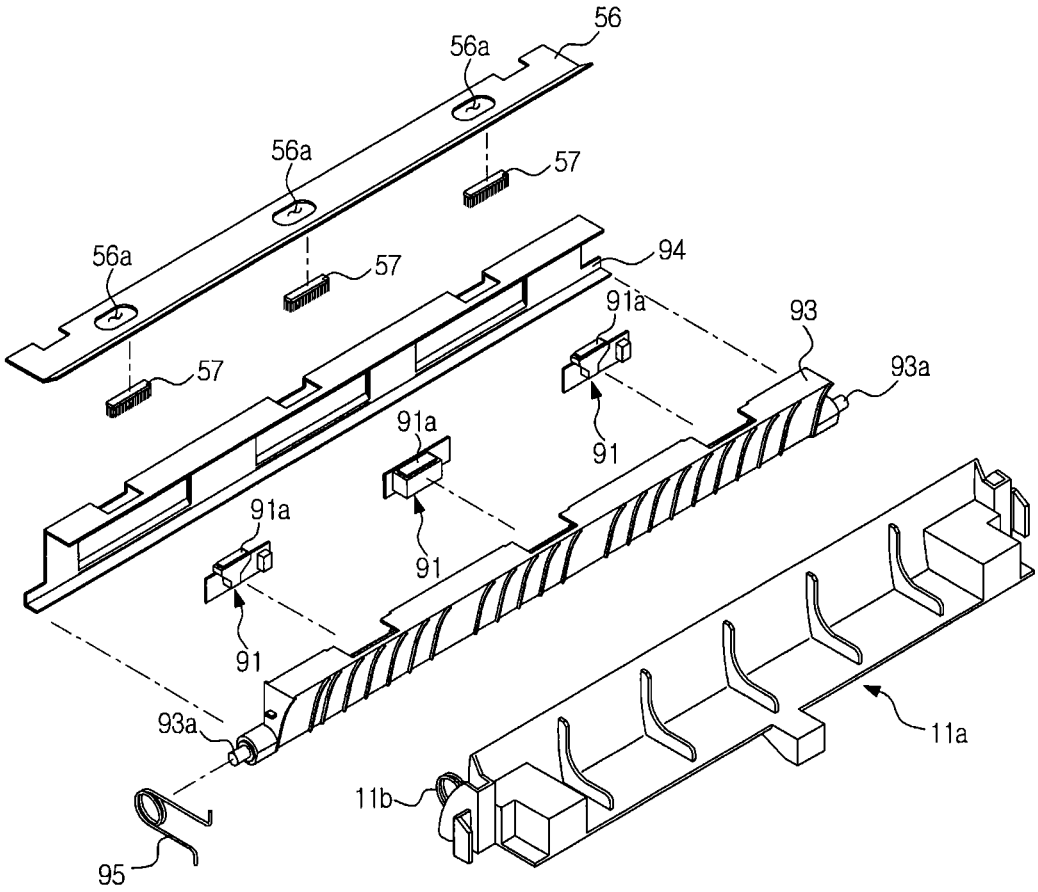
FIG. 2 is an exploded perspective view of a sensor unit of the image forming apparatus in accordance with the embodiment of the present invention.

Further, the image forming apparatus includes a sensor unit 90 checking the developers on the intermediate transfer belt 51 to execute color registration. The sensor unit 90, as shown in FIG. 2, includes a plurality of developer concentration sensors 91 sensing concentrations of the developers on the intermediate transfer belt 51, and two sensor housings 93 and 94 connected to each other such that the plural developer concentration sensors 91 are installed therebetween. The developer concentration sensor 91 is an optical sensor, and a light window 91 a to pass light is provided on the upper surface of the developer concentration sensor 91.

A reinforcing frame 56 to reinforce the strength of the transfer device 50 is provided on the transfer device 50, and through holes 56*a* are provided on the reinforcing frame 56 at positions corresponding to the light windows 91 a of the sensor unit 90 so as to check the developers on the intermediate transfer belt 51 through the developer concentration sensors 91.

In order to clean the light windows 91*a*, the light windows 91 a are located at first positions (with reference to FIG. 3) opposite the intermediate transfer belt 51 and second positions (with reference to FIG. 6) exposed to the opening 10*c* in connection with the opening and closing operation of the cover 11 opening and closing the opening 10*c*. That is, in a state that the cover 11 closes the opening 10*c*, the light windows 91*a* are located at the first positions to sense the concentrations of the developers on the intermediate transfer belt 51 through the through holes 56*a*, and in a state that the cover 11 opens the opening 10*c*, the light windows 91*a* are exposed to the opening 10*c* to allow a user to clean the light windows 91 a through the opening 10*c*.

In order to move the light windows 91*a* between the first positions and the second positions, as described above, the sensor unit 90 is installed within the main body 10 so as to be rotatable, and the cover 11 includes a pressure part 11*a* protruding to the inside of the opening 10*c* and applying pressure to the sensor unit 90 to rotate the sensor unit 90 to move the light windows 91 a to the first positions. Here, a support member 11*b* elastically supporting the sensor unit 90 is disposed on the pressure part 11*a*.

Hinge parts 93*a* allowing the sensor unit 90 to be rotatably installed within the main body 10 protrude from both sides of one of the two sensor housings 93 and 94 of the sensor unit 90.

An elastic member 95 including a torsion spring and elastically supporting the sensor unit 90 to rotate the sensor unit 90 is installed on at least one of the two hinge parts 93*a*. Therefore, in a state that the pressure part 11*a* does not apply pressure to the sensor unit 90, the sensor unit 90 is rotated by elastically restoring force of the elastic member 95, and thus the light windows 91*a* of the sensor unit 90 move to the second positions.

Further, brushes 57 are disposed between the first positions and the second positions so that the light windows 91*a* may be cleaned by the brushes 57 during the moving process of the light windows 91*a* between the first positions and the second positions. In this embodiment, the brush 97 is disposed at one side of the through hole 56*a* of the reinforcing frame 56.

Hereinafter, the operation of the image forming apparatus having the above configuration will be described with reference to the accompanying drawings.

Figure 3:
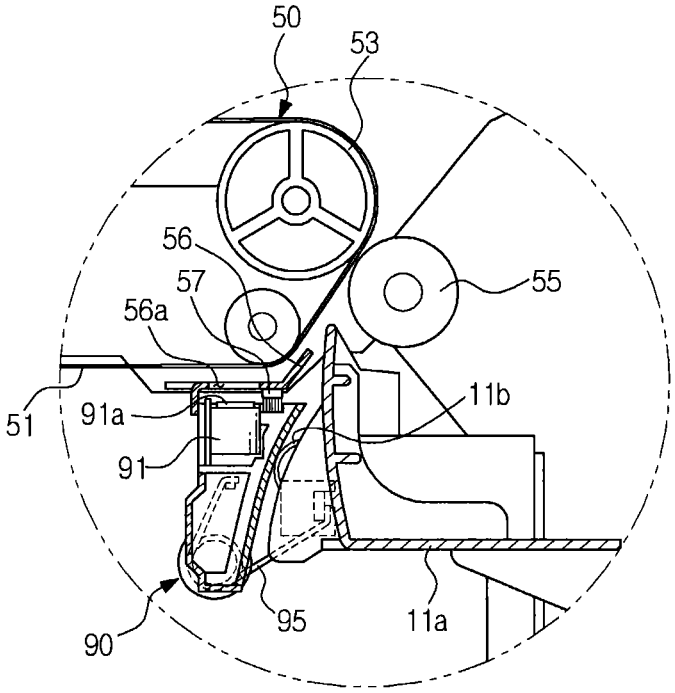
FIG. 3 is a cross-sectional view illustrating the sensor unit of the image forming apparatus in accordance with the embodiment of the present invention in a state in which an opening is closed.

First, in the state that the cover 11 closes the opening 10*c*, the sensor unit 90 is elastically supported by the support member 11*b* disposed on the pressure part 11*a*, as shown in FIG. 3, and thus the light windows 91 a of the sensor unit 90 maintain the first positions opposite the intermediate transfer belt 51 via the through holes 56*a*.

Figure 4:
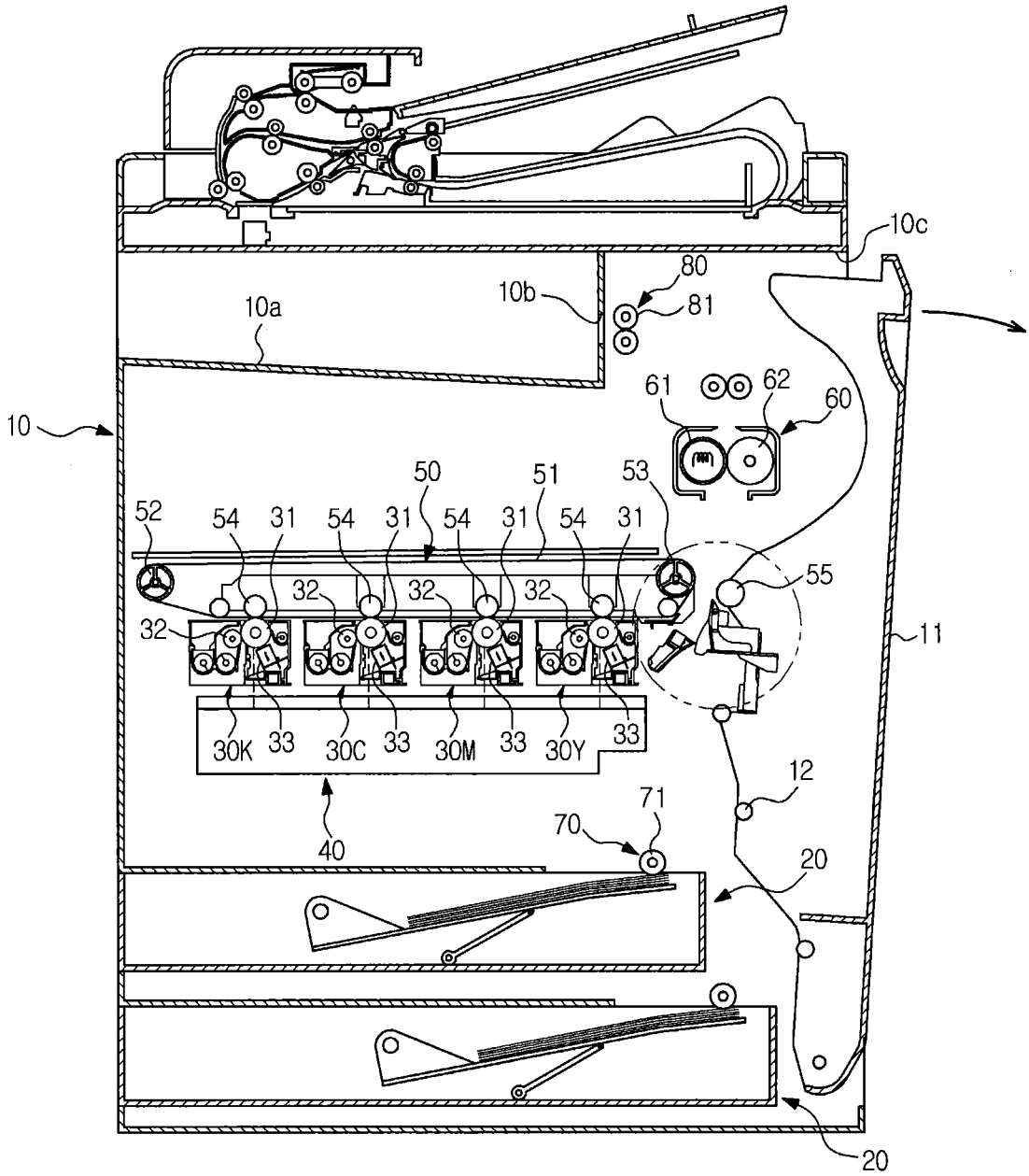
FIG. 4 is a cross-sectional view illustrating the sensor unit of the image forming apparatus in accordance with the embodiment of the present invention in a state in which the opening is opened.

When a user rotates the cover 11 to open the opening 10*c* in such a state, as shown in FIG. 4, the pressure part 11*a* supporting the sensor unit 90 is separated from the sensor unit 90 by rotation of the cover 11, and thus the sensor unit 90 is rotated in the clockwise direction (with reference to the drawings) with respect to the hinge parts 93*a* by the elastically restoring force of the elastic member 95. Therefore, the light windows 91*a* move from the first positions to the second positions.

Figure 5:
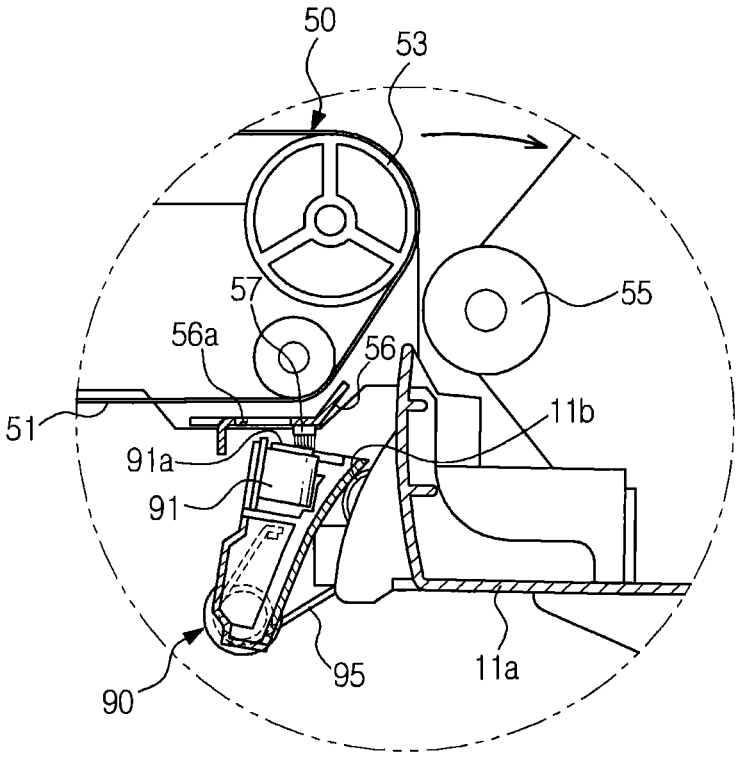
FIGS. 5 and 6 are cross-sectional views illustrating the sensor unit of the image forming apparatus in accordance with the embodiment of the present invention, which is operated in connection with a cover.

Since the brushes 57 are provided between the first positions and the second positions, as described above, when the light windows 91*a* move from the first positions to the second positions, the light windows 91*a* pass through the brushes 57, as shown in FIG. 5, and are thus cleaned by the brushes 57. That is, the light windows 91 a are first cleaned by the brushes 57, and thus cleaning of the light windows 91*a* is more simplified.

Figure 6:
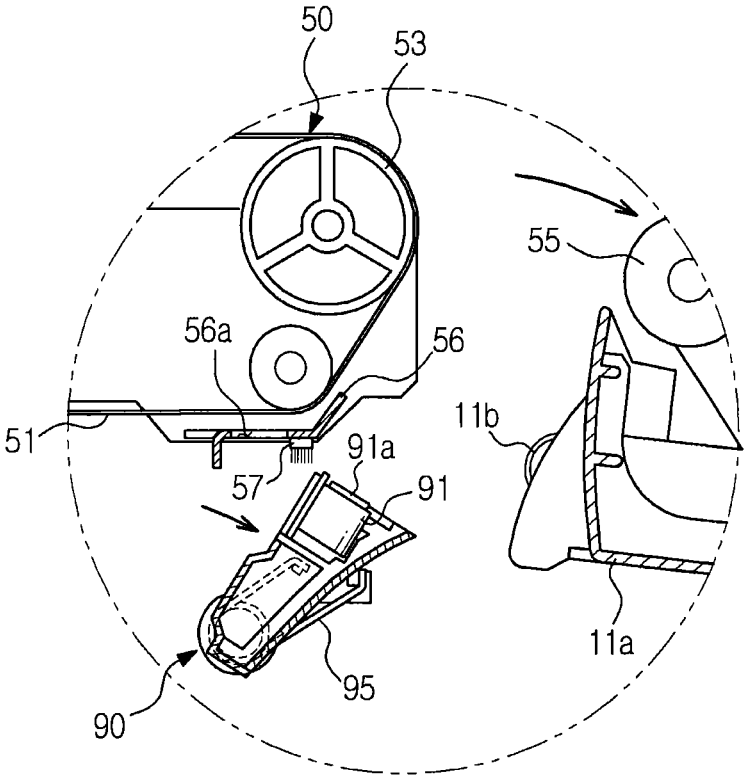

Even after the light windows 91 a have passed through the brushes 57, the sensor unit 90 is continuously rotated, and thereby the light windows 91*a* of the sensor unit 90 move to the second positions exposed to the opening 10*c*, as shown in FIG. 6. When the light windows 91*a* are exposed to the opening 10*c*, as described above, the user may clean directly the light windows 91*a* through the opening 10*c*.

On the other hand, when the user rotates the cover 11 to close the opening 10*c*, the pressure part 11*a* applies pressure to the sensor unit 90 by rotation of the cover 11. Thereby, the sensor unit 90 is rotated in the counterclockwise direction (with reference to the drawings) with respect to the hinge parts 93*a*, and the light windows 91*a* move from the second positions to the first positions. In this state, the developer concentration sensors 91 may check the intermediate transfer belt 51. Even when the opening 10*c* is closed, as described above, the light windows 91*a* again pass through the brushes 57, thus being cleaned also.

Although this embodiment illustrates the light windows 91*a* as moving between the first positions opposite the intermediate transfer belt 51 and the second positions exposed to the opening 10*c* according to rotation of the sensor unit 90, movement of the light windows 91*a* is not limited thereto. That is, the light windows 91*a* may be operated in various manners, such as a manner in which the sensor unit 90 moves forwards and backwards according to opening and closing of the cover 11 and the light windows 91*a* move between the first positions and second positions in connection with forward and backward movement of the sensor unit 90.

As is apparent from the above description, in an image forming apparatus in accordance with one embodiment, light windows of a sensor unit are exposed to an opening according to opening of the opening by a cover, and thus a user may clean the light windows of the sensor unit through the opening after the opening has been opened by the cover.

Further, while the light windows of the sensor unit move between first positions and second positions according to opening and closing of the opening by the cover, the light windows are cleaned by brushes, and thus cleaning of the light windows is simply carried out.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a main body provided with an opening;

a cover to open and close the opening;

a plurality of development units developing electrostatic latent images into visible images through developers;

a transfer device including an intermediate transfer belt receiving the developers from the plurality of development units and transferring the developers to printing media; and a sensor unit provided with light windows located at first positions opposite the intermediate transfer belt when the opening is closed by the cover, and located at second positions exposed to the opening when the opening is opened by the cover;

a plurality of brushes disposed between the first positions and the second positions.

2. The image forming apparatus according to claim 1, wherein the sensor unit is rotatably installed within the main body and rotated such that the light windows move to one of the first positions and second positions.

3. The image forming apparatus according to claim 1, further comprising an elastic member elastically supporting the sensor unit to rotate the sensor unit.

4. The image forming apparatus according to claim 3, wherein:

the sensor unit includes two hinge parts respectively protruding from both sides of the sensor unit to rotatably install the sensor unit within the main body; and the elastic member includes a torsion spring and is installed on at least one of the two hinge parts.

5. The image forming apparatus according to claim 1, wherein:

the sensor unit includes at least one developer concentration sensor sensing concentrations of the developers on the intermediate transfer belt; and the light windows are provided on the at least one developer concentration sensor.

6. The image forming apparatus according to claim 1, wherein the cover includes:

a pressure part protruding toward the sensor unit; and a support member disposed on the pressure part to elastically support the sensor unit.

7. The image forming apparatus according to claim 1, wherein:

the transfer device further includes a reinforcing frame to reinforce the strength of the transfer device;

through holes are provided on the reinforcing frame at positions corresponding to the light windows located at the first positions; and each of the brushes is located at one side of each of the through holes of the reinforcing frame.

8. An image forming apparatus comprising:

a main body provided with an opening;

a cover to open and close the opening;

a plurality of development units developing electrostatic latent images into visible images through developers;

a transfer device including an intermediate transfer belt receiving the developers from the plurality of development units and transferring the developers to printing media;

a sensor unit provided with light windows located at first positions opposite the intermediate transfer belt when the opening is closed by the cover, and located at second positions separated from the first positions when the opening is opened by the cover; and brushes disposed between the first positions and the second positions.

9. The image forming apparatus according to claim 8, wherein:

the transfer device further includes a reinforcing frame to reinforce the strength of the transfer device;

through holes are provided on the reinforcing frame at positions corresponding to the light windows located at the first positions; and each of the brushes is located at one side of each of the through holes of the reinforcing frame.

10. The image forming apparatus according to claim 8, wherein the sensor unit is rotatably installed within the main body and rotated such that the light windows move to one of the first positions and second positions.

11. The image forming apparatus according to claim 10, further comprising an elastic member elastically supporting the sensor unit to rotate the sensor unit.

12. The image forming apparatus according to claim 11, wherein:

the sensor unit includes two hinge parts respectively protruding from both sides of the sensor unit to rotatably install the sensor unit within the main body; and the elastic member includes a torsion spring and is installed on at least one of the two hinge parts.

13. The image forming apparatus according to claim 8, wherein:

the sensor unit includes at least one developer concentration sensor sensing concentrations of the developers on the intermediate transfer belt; and the light windows are provided on the at least one developer concentration sensor.

14. The image forming apparatus according to claim 8, wherein the cover includes:

a pressure part protruding toward the sensor unit; and a support member disposed on the pressure part to elastically support the sensor unit.

15. The image forming apparatus according to claim 8, wherein the second positions are positions where the light windows are exposed to the opening.

16. An image forming apparatus comprising:

a main body provided with an opening;

a cover to open and close the opening;

a plurality of development units developing electrostatic latent images into visible images through developers;

a transfer device including an intermediate transfer belt receiving the developers from the plurality of development units and transferring the developers to printing media;

a rotatable sensor unit provided with light windows located at first positions opposite the intermediate transfer belt when the opening is closed by the cover, and located at second positions exposed to the opening when the opening is opened by the cover; and a plurality of brushes disposed between the first positions and the second positions;

wherein the cover further comprises a pressure part that supports and guides the rotation of the sensor unit as it rotates between the first and second position and as it rotates between the second and first position.

17. The image forming apparatus according to claim 16, wherein the pressure part further comprises an elastic support element that supports and maintains the position of the sensor unit in the first position while the cover is in a closed position.

18. The image forming apparatus according to claim 16, wherein:

the transfer device further includes a reinforcing frame to reinforce the strength of the transfer device;

through holes are provided on the reinforcing frame at positions corresponding to the light windows located at the first positions; and each of the brushes is located at one side of each of the through holes of the reinforcing frame.

* * * * *